United States Patent [19]

Humlicek

[11] 4,103,058

[45] Jul. 25, 1978

[54] PILLOWED WEB OF BLOWN MICROFIBERS

[75] Inventor: Larry D. Humlicek, Rice Lake, Wis.

[73] Assignee: Minnesota Mining and Manufacturing Company, Saint Paul, Minn.

[21] Appl. No.: 667,089

[22] Filed: Mar. 15, 1976

Related U.S. Application Data

[63] Continuation of Ser. No. 507,879, Sep. 20, 1974, abandoned.

[51] Int. Cl.[2] ..... B32B 3/00; B32B 27/02

[52] U.S. Cl. ..... 428/171; 156/62.4; 264/176 F; 264/DIG. 75; 428/178; 428/180; 428/288; 428/296; 428/401; 428/903

[58] Field of Search ..... 156/62.2, 62.4, 181, 156/244, 183; 264/DIG. 75, 210 F, 176 F, 8; 428/903, 171, 159, 158, 296, 288, 401, 92, 180, 174

[56] References Cited

U.S. PATENT DOCUMENTS

| | | | |
|---|---|---|---|
| 1,316,010 | 9/1919 | Zocher | 428/292 |
| 2,493,968 | 11/1950 | Hepner | 428/292 |
| 3,266,969 | 8/1966 | Makansi | 428/92 |
| 3,841,953 | 10/1974 | Lohkamp et al. | 428/296 |
| 3,905,863 | 9/1975 | Ayers | 162/117 |

*Primary Examiner*—George F. Lesmes
*Assistant Examiner*—Stanley S. Silverman
*Attorney, Agent, or Firm*—Cruzan Alexander; Donald M. Sell; Roger R. Tamte

[57] ABSTRACT

A novel blown microfiber web having a network of compacted high-density regions and pillowed low-density regions exhibits a unique combination of low density and good tensile strength and integrity. Such a web may be collected on a perforated screen so that microfibers deposited on the land area of the screen form the compacted high-density regions, and microfibers deposited over the openings of the screen form the pillowed low-density regions.

15 Claims, 6 Drawing Figures

PILLOWED WEB OF BLOWN MICROFIBERS

This is a continuation of application Ser. No. 507,879 filed Sept. 20, 1974 now abandoned.

INTRODUCTION

The present invention provides blown-microfiber webs having a radically different structure that enhances previous uses and provides new uses for microfiber webs.

Conventionally, "blown microfibers" — which are discrete, very fine, discontinuous fibers prepared by extruding liquified fiber-forming material through fine orifices in a die into a high-velocity gaseous stream, where the extruded material is first attenuated by the gaseous stream and then solidifies as a mass of the fibers — are collected on a small-mesh wire screen moved transversely through the gaseous stream. The openings in the screen permit passage of a portion of the gaseous stream, but the fibers collect on the screen as a flat, or constant-thickness, coherent web. The web is most often used in its collected form after being removed from the collection screen and cut to useful sizes.

In contrast to conventional flat webs, microfiber webs of the present invention have a network of compacted high-density regions and pillowed low-density regions. This unique structure can be obtained by making novel use of the perforations in a collection screen. For example, I have found that microfibers may be collected on a honeycombed collection screen, which has large-diameter honeycomb openings, and in which the land area consists only of the edges of the thin walls dividing the honeycomb openings. Although blown at the collection screen with sufficient force that they penetrate into the openings, the microfibers continuously bridge over and close the openings. At the land areas, the collected microfibers become at least somewhat compacted, but at the openings, low-density "pillows" of microfibers are formed.

FIG. 1 shows in perspective an illustrative web 10 prepared by this procedure, having compacted high-density regions 11 and pillowed low-density regions 12. Each pillowed low-density region 12 spans the space between adjacent compacted regions and is expanded and displaced out of the plane of the compacted regions (the distance "*a*" in FIG. 1) in an arched configuration.

The pillowed low-density regions 12 may be made with such a low density that the overall density of the web is lower than previous blown microfiber webs of comparable tensile strength, and the internal volume and exterior surface area of the web are greatly increased. Despite their low density and high volume, the new microfiber webs have good, even improved integrity, handleability, and tensile strength because of the network of compacted high-density regions. Further, microfibers are held in webs of the invention more firmly than in conventional webs because of the tight intertwining, and sometimes even bonding or fusing, of the fibers in the compacted high-density regions of the web. As a result, microfiber webs of the invention resist "pilling" or fuzzing when rubbed against a substrate or other article.

The anchoring of the microfibers also contributes to a resilient nature for the pillows, such that moderate pressure on the pillows does not crush them. Typically, the perimeter of the pillows adjacent to the compacted areas is also compacted, providing a rigidity that contributes to the resilient nature of the pillows.

Often the microfibers in the pillows tend to be arranged in spaced layers, such as the layers 13 shown for the web 10 in FIG. 1. Within a layer, the microfibers are randomly intermingled and intertwined, and the layers are anchored at their sides by the adjacent compacted areas.

Several advantages and uses arise from the unique structure of microfiber webs of the invention. For example microfiber webs of the invention have greater capacity to sorb and retain liquid than conventional flat webs, increasing their utility for cleanup, collecting, or separating operations, such as separating oil from water, and for filtering. Further, their volume and low overall density adapt them to use as sound or thermal insulation. Another use is as high-volume fillers for packaging, cushioning, or flotation purposes.

All in all, the new structure opens the way to many new and increased uses for blown-microfiber webs.

BACKGROUND PRIOR ART

Microfiber webs of the invention have a partial similarity to calendered constant-thickness microfiber webs of the type suggested in Francis, U.S. Pat. No. 2,464,301, and Prentice, U.S. Pat. No. 3,704,198. In these calendering procedures, the webs are pressed with a heated platen or roll having projections that cause the webs to be compacted and fused together at spaced locations. The result is a plural-density web, with the areas of high density being intended to strengthen the web.

However, microfiber webs of the present invention are unique over such prior-art calendered webs both in structure and utility. Whereas a calendering operation increases the density and reduces the volume of a conventional flat web, procedures of the present invention generally provide a lower density and a greater volume than exhibited by such a conventional flat web. That is, pillowed regions of microfiber webs of the invention have an expended nature because they are collected over an opening. Similarly, collection over an opening gives rise to displacement of the pillowed regions above the level of the compacted regions in the manner shown in FIG. 1, a structure that does not result from calendering of a constant-thickness web.

Thus, while microfiber webs of the invention have the increased tensile strength and integrity that is the object of calendering, at the same time they have a lower density and greater volume and surface area. The result is an increased utility, as previously described.

Another background reference is an article by R. R. Buntin and D. T. Lohkamp entitled "Melt-Blowing — A One-Step Process for New Nonwoven Products," TAPPI, Volume 56, No. 4, pp. 74–77, reportedly presented as a paper on Oct. 23–24, 1972. In this article it is suggested that microfibers can be collected on a "patterned" surface in such a way as to cause the web to conform to the collector surface, and thereby form a variety of "dimpled or waffle-patterned webs." A fundamental difference between my procedure and the procedure described in the article is that in my procedure, microfibers are collected over open areas of a collection screen so that the microfibers penetrate into the openings. The low-density pillows formed by this penetration are unlike any structure that is formed when microfibers are collected on a surface.

Other background references are the many prior-art teachings directed to preparation of microfiber webs, including such publications as Report No. 4364 of the Naval Research Laboratories, published May 25, 1954, entitled "Manufacture of Superfine Organic Fibers," by Wente, Van A.; Boone, C. D.; and Fluharty, E. L.; and a more brief discussion in Wente, Van A., "Superfine Thermoplastic Fibers," in *Industrial Engineering Chemistry,* Volume 48, page 1342 et seq (1956); and such patents as Francis, U.S. Pat. No. 2,483,406; Ladisch, U.S. Pat. No. 2,612,679; Till et al, U.S. Pat. No. 3,073,735; and Mabru, U.S. Pat. No. 3,231,639. None of these prior-art teachings contemplates formation of low-density pillowed microfiber webs such as the webs of the inventions.

In summary, insofar as I am aware, the prior art has never contemplated microfiber webs such as the unique pillowed microfiber webs of the invention, with their combination of low density, high volume, high exterior surface area, and good web integrity. Nor, insofar as I am aware, has the prior art contemplated the preparation of such plural-density webs by a direct single-step collection procedure, which requires no further steps such as calendering after the collection operation is completed.

DETAILED DESCRIPTION

Figure 2:
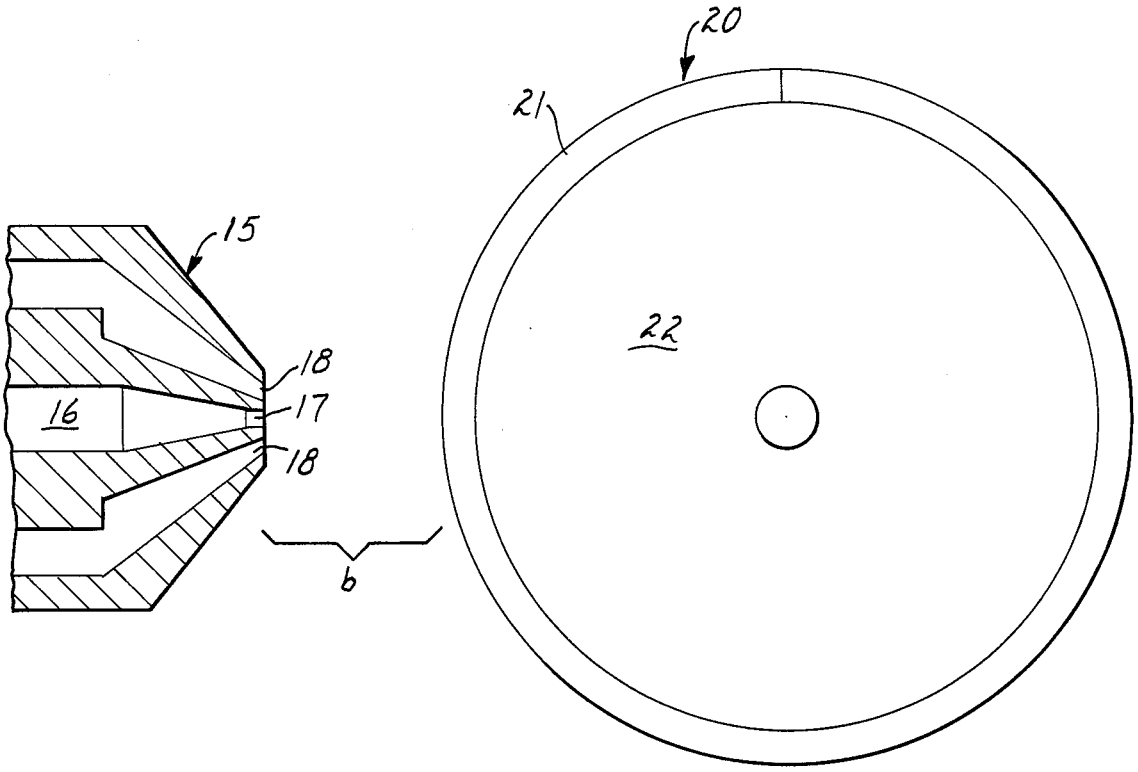
FIG. 2 is a schematic diagram of microfiber-blowing apparatus used in the present invention.
Figure 3:
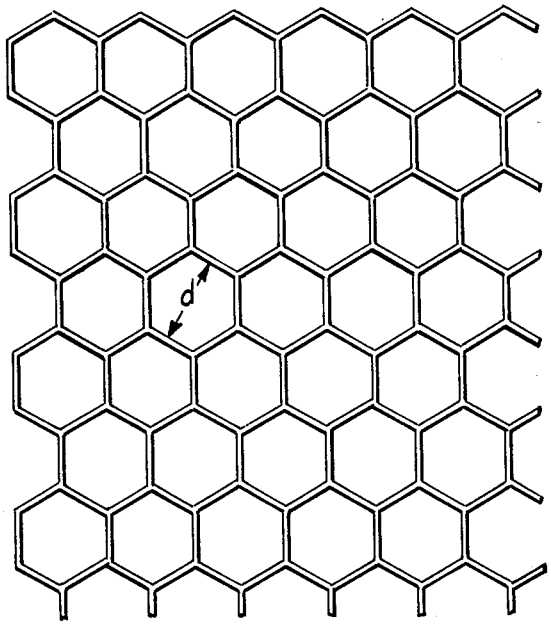
FIGS. 3–6 are plan view of portions of collection screens used in the present invention.
Figure 4:
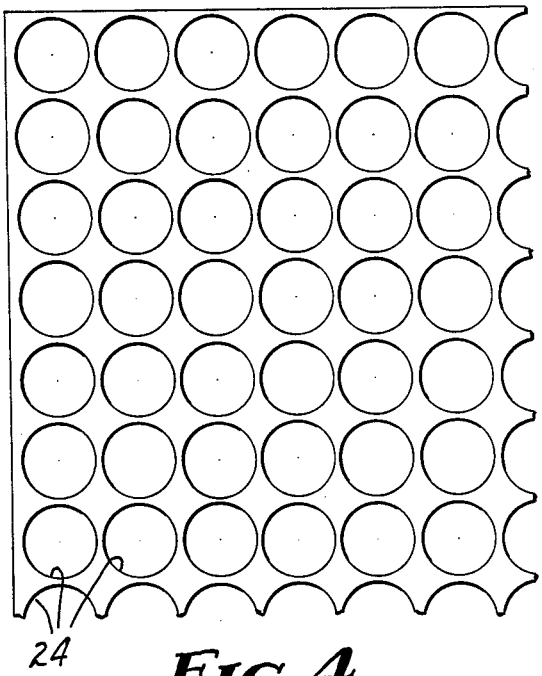
Figure 5:
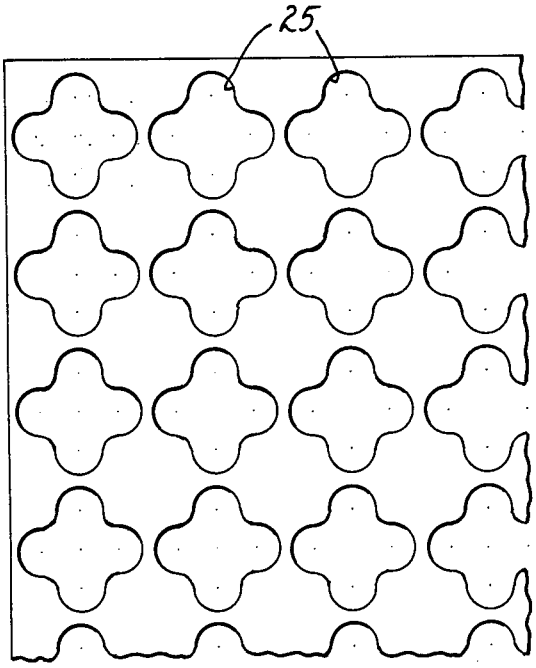

FIG. 2 schematically shows illustrative apparatus for forming polymeric microfiber webs of the present invention. The microfiber-blowing portion of the apparatus, for forming microfibers and directing them in a gaseous stream toward a collector, can be a conventional apparatus such as described in references cited above, including the article "Superfine Thermoplastic Fibers" and Prentice, U.S. Pat. No. 3,704,198. Such apparatus generally includes a die 15, which has an extrusion chamber 16 through which liquified polymeric material is advanced; a set of polymer orifices 17 arranged in line across the forward end of the die; and gas orifices 18 adjacent to the polymer orifices. A gas, usually air, is supplied at high velocity through the orifices 18 and directed toward the path of polymeric material extruded from the polymer orifices 17. The high-velocity gaseous stream draws out and attenuates the polymeric material extruded through the polymer orifices, whereupon the attenuated polymeric material solidifies as microfibers during travel to a collector 20.

The collector 20 comprises an appropriate collection screen 21, which in this illustrative apparatus is wrapped around parallel discs 22. Supporting structure for the collection screen may extend between the discs; for example, a small-mesh screen may be used to support a flexible collection screen that has sufficient depth to permit formation of the desired pillows in a collected web. A low-pressure region may be developed within the interior of the drum formed by the screen 21 and discs 22 to improve the withdrawal of the gas stream and to aid the penetration of microfibers into the openings of the collection screen. Once a microfiber web has been collected on the collection screen 21, it is usually removed from the collection screen at a point remote from the deposition area and wound into a storage roll, whereupon it can be later used as is; cut into desired configurations; added to other structure, as by lamination to another sheet, or otherwise processed.

Several parameters of the microfiber-blowing procedure may be varied, typically in interrelated ways, to change the form and dimensions of the collected web. The following discussion describes exemplary structures and ranges as guidelines for practicing the invention, but values outside the stated ranges may be selected when pillowed microfiber webs of the invention are prepared for certain uses.

Some of the useful collection screens are shown in plan view in FIGS. 3–6. The collection screen shown in FIG. 3 may be either a honeycombed screen, in which the only land area consists of the edges of thin walls that divide the honeycomb cells, or a flat plate having hexagonal openings stamped in it. Such collection screens, in which the land area comprises connected linear areas (which vary in width up to 5 millimeters, or even more), are preferred for preparing most pillowed microfiber webs of the invention since they generally provide webs of the lowest overall density with a good web integrity. However, collection screens having larger land areas are also useful, and perforations may be configured, as the perforations 24 and 25 of the screens shown in FIGS. 4 and 5, to provide pillows of a desired shape.

Figure 6:
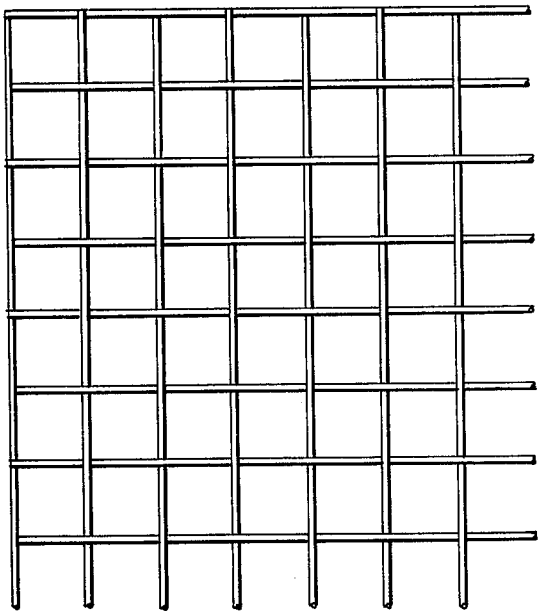

FIG. 6 shows a mesh or netting of filaments, which as taught in a copending patent application of Kruger, Ser. No. 507878, filed 3/15/76 (the same day as this application was filed), can be used as a collection screen and becomes part of the resulting web. The mesh generally comprises polymeric reinforcing filaments which strengthen the collected web of microfibers. The microfibers in the compacted regions may become bonded to the mesh to further secure the mesh within the web. In preparing such a reinforced web, the mesh may be unwound from a supply roll, drawn over two generally parallel wheels arranged adjacent the die so that fibers are collected on the mesh, and then drawn to a storage roll.

The land area of useful collection screens can vary widely, from as little as a tenth of a percent to 90 percent of the whole area of the screen. Preferably it is less than about 60 percent of the whole area of the screen, and often is about 1–5 percent. Where the land area is small, the opening size in the screen may also be small, for example, as small as 2 or 3 millimeters though it is usually 5 millimeters or more.

The collection distance, that is, the distance between the die orifice and the collection screen ("*b*" in FIG. 2), may also be varied to vary, for example, the depth of penetration by fibers into the perforations of the collection screen and consequently the height of the pillows formed in the web. As the opening size in the collection screen is increased, the distance from collection screen to die may also be increased, to obtain an optimum low-density pillow. The ratio between the collection distance and the diameter of the opening usually ranges between about 5:1 and 10:1 for optimum results.

The collection distance will generally be not less than about 2 centimeters, and preferably not less than about 4 centimeters, at least in a melt-blowing operation, so that the compacted regions collected on the lands of the collection screen will be fibrous rather than film-like, and therefore more tear-resistant. It is usually impractical to use collection distances greater than about 30 centimeters, and preferably the collection distances are less than 15 centimeters, so as to provide a rather uniform distribution of fibers over the collection area. If the collection distance is too long for the particular collection screen being used, inadequate penetration is obtained, which in the extreme case results in webs of nearly constant thickness being formed. Formation of low-density pillowed regions has been observed at collection distances up to 75 centimeters when using a collection screen having one-centimeter-diameter openings; but the pillows of such webs have not exhibited the spaced-layer nature, which is preferred for certain purposes.

Figure 1:
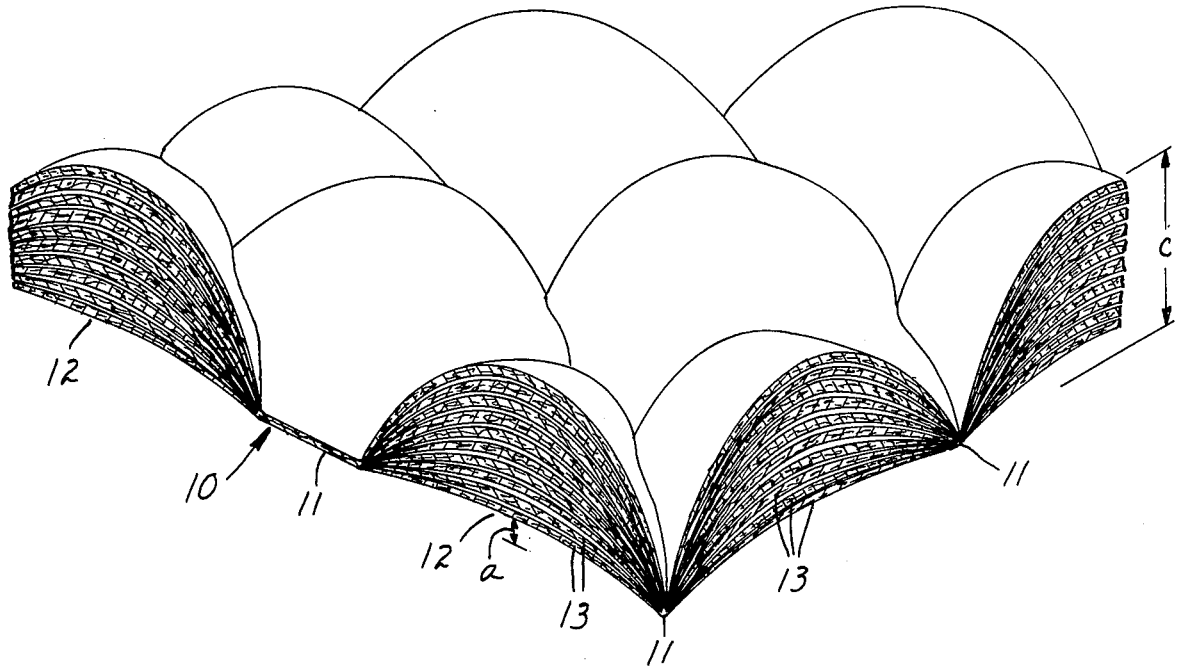
FIG. 1, as previously noted, is a perspective view partially in section, of a portion of an illustrative pillowed microfiber web of the invention.

The velocity of the gas streams carrying the microfibers to the collector may also be varied, to control, for example the height of pillows formed in the web. Manifold pressures (pressure of gas prior to introduction to die) generally less than about 25 pounds per square inch gauge, (or 2 kilograms per square centimeter), and preferably less than about 15 pounds per square inch gauge (or 1 kilogram per square centimeter), may be used when the air-delivery orifice (the orifice 18 in FIG. 2) has a width of 0.3 millimeter, so that the microfibers are not driven into the perforations of the carrier too forcefully. The front side of a web of the invention (that is, the top of the sample microfiber web of the invention shown in FIG. 1) should have an unbroken surface (through open at interstices between fibers) for most uses of the web, and such a continuous surface is prevented by excessive velocity. Generally the air manifold pressure is more than about 4 pounds per square inch gauge (0.3 kilogram per square centimeter) and perferably more than about 6 pounds per square inch gauge (0.4 kilogram per square centimeter) when the air-delivery orifice has a width of 0.3 millimeter. The highest velocities can be used when the collection distance is large, and the specific velocity used is often chosen by varying the velocity and collection distance on a trial basis for a given collection screen.

Microfibers may be made from nearly any fiber-forming material that may be liquified, as by melting or dissolving, to the viscosities used in microfiber-blowing operation. A preferred polymer for melt-blown microfibers is polypropylene, which is especially suited for use in oil-sorbing products. Other useful polymers for melt-blown microfibers include polyethylene, polyethylene terephthalate, nylons, and other polymers as known in the art. For solution-blowing, such polymers as polyvinylchloride, polystyrene, and polyarylsulfone are used. Inorganic materials also form useful blown microfibers.

The bulk of the microfibers collected in a melt-blowing operation normally have diameters between about 1 and 20 micrometers, though they may vary somewhat outside this range; and they may have lengths of 10 centimeters or more. The finer the fibers, and the lower the web density, the higher the capacity of the web to sorb oil. On the other hand, coarser fibers are not as delicate, are more abrasion resistant, and are capable of more stringent use. For special applications, for example, as reuseable oil-sorbing units, a multilayer construction may be provided, comprising two coarse-fiber outer layers that protect an inner high-capacity finefiber layer. Such a web is conveniently manufactured using a three-stage apparatus, with three separate dies arranged sequentially along a path on which a collection screen is moved. Webs may also be prepared having a mixture of microfibers, of different size or composition, for example.

The density of the pillows formed varies depending on the height of the pillows, the collection distance, the velocity of the gaseous stream carrying the microfibers to the collector, the rate at which the collection screen is moved through the gaseous stream, and the ratio of gas to polymer passed through the extrusion apparatus. In addition, the basis weight of the web (that is, the weight of fibers per unit of area) can be varied by controlling such parameters and also by using a plurality of dies or a plurality of passes under one die so as to apply more than one layer of microfibers.

For certain uses of the microfiber web in which low-density high-volume pillows are needed, for example, when the web is to be used as a collector for fluids, the pillows have a density less than about 0.02 gram/cubic centimeter. For other uses, where the webs are to be used, for example, as filter media, thermal insulation, and acoustic barriers, the density of the pillows may be lower, such as about 0.004 gram/cubic centimeter. The density of the compacted regions can also be varied somewhat but generally is at least about 0.2 gram per cubic centimeter. The ratio of the densities of low-density and high-density regions in a web of the invention can be varied depending on the use that is to be made of the web. Generally that ratio is at least 20:1, and preferably 30:1, or more. Microfiber webs of the present invention are usually at least 5 millimeters thick, (the distance "*c*" in FIG. 1), and for many uses are at least 1–3 centimeters thick. (It may be noted that calendered constant-thickness microfiber webs of the prior art generally have density ratios less than 10:1 and are generally only a fraction of a millimeter thick.) The overall density of a web of the invention is generally less than 0.05 gram/cubic centimeter, and for many uses is less than 0.02 gram per cubic centimeter.

Microfiber webs of the invention may be loaded with various other materials, such as resins, dyes, adhesives, etc., as by introducing such materials into the liquified polymer prior to extrusion, by impregnating them into a preformed web, or by introducing the materials into the gaseous stream so that they are captured within the web as formed. Particle-loaded pillowed microfiber webs may be made as shown in a copending patent application of Braun, Ser. No. 435,198, filed Jan. 21, 1974. As described in that application, particle-loaded webs may be made with apparatus comprising one or more dies such as the die 15 shown in FIG. 2 and a delivery conduit for particles. For example, one die may be arranged on each side of the delivery conduit so that the streams of microfibers issuing from the dies intersect in front of the delivery conduit to form one stream of microfibers that continues to a collector. The stream of particles intercepts the two streams of microfibers at the latter's point of intersection.

The webs prepared are especially useful for presenting a three-dimensional arrangement of particles in which the particles can interact with (for example, chemically or physically react with, or physically contact or be modified by) a medium to which the particles are exposed. The particles are physically entrapped within the interstices of the web and no binder material is required to hold them in place for typical useful functions of the web. The result is that the particles are generally held in the web so that the full surface of the particles is exposed for interaction with a medium to which the product or web is exposed.

Any kind of solid particle that may be dispersed in an air stream ("solid" particle, as used herein, refers to particles in which at least an exterior shell is solid, as distinguished from liquid or gaseous). The particles may vary in size, at least from 5 micrometers to 5 millimeters in average diameter; most often they are between 50 micrometers and 2 millimeters in average diameter. Generally the ratio of the average diameter of the particles to the average diameter of the microfibers is at least about 4 or 5 to 1 to provide good entrapment of the particles by the fibers, and preferably is at least 10 to 1.

When more than one layer of blown microfibers is collected to form a web, succeeding layers may cover or fill the displacement of the pillowed regions (represented by the distance "*a*" in FIG. 1) so that such a displacement is not visible at the back of the web. However the expanded and displaced nature of the first deposited layer of microfibers is not affected by such a covering or filling, and the web still exhibits distinctive properties arising from that structure. The covering layer may be applied during a separate pass of the web under a die, or both the first and covering layer may be formed in a single pass in front of a single die by moving the collection screen past the die very slowly.

The invention will be further illustrated by the following examples.

EXAMPLES 1–19

A series of microfiber webs of the invention were made using a variety of different conditions as shown in Table I. Some of the physical characteristics of these webs are also reported in Table I. The tensile strength reported is strip tensile strength as measured according to ASTM D-828-60, except that the spacing between the clamps was 5 centimeters and the elongation rate was 250 percent per minute. Strip tensile strength is recorded in meters, the unit resulting when the force required to break the web (grams) is divided by the width of the sample (meters), and then divided by the basis weight of the sample (the overall weight of the fibers in the web per unit of area of the web) in grams per square meter.

TABLE I

| Example No. | 1 | 2 | 3 | 4 | 5 | 6 | 7 | 8 | 9 |
|---|---|---|---|---|---|---|---|---|---|
| Material of Microfibers | Polypropylene (melt flow of 12 grams/10 minutes) | | | | | | | | |
| Extruder Temperature (° C) | 316 | 316 | 316 | 316 | 316 | 316 | 316 | 316 | 316 |
| Die Temperature (° C) | 343 | 343 | 343 | 332 | 332 | 329 | 329 | 343 | 321 |
| Air Temperature (° C) | 454 | 454 | 454 | 454 | 454 | 454 | 454 | 454 | 454 |
| Air Flow to Die (standard liters for second) | 6.6 | 6.6 | 6.4 | 7 | 7 | 7 | 7 | 7 | 7 |
| [1]Air Pressure (kg/cm$^2$) | 0.56 | 0.56 | 0.42 | 0.56 | 0.56 | 0.56 | 0.56 | 0.56 | 0.56 |
| [2]Polymer Rate (g/min) | 20.6 | 19 | 21 | 16 | 16 | 12.7 | 12.7 | 18 | 19 |
| Collection Distance (centimeters) | 7 | 7 | 6.3 | 6.3 | 6.3 | 5.7 | 5.7 | 15 | 7.5 |
| Screen Velocity (cm/sec) | 6.6 | 6.9 | 6.9 | 6.9 | 6.9 | 7.7 | 7.7 | | 6.4 |
| Screen Type (figures of drawing) | 3 | 3 | 3 | 3 | 3 | 3 | 4 | 3 | 3 |
| Width of Openings in Screen ("d"in FIG. 3) (centimeters) | 1.1 | 1.1 | 1.1 | 1.1 | 1.1 | 1.1 | 1.25 | 4 | 1.1 |
| Percent Open Area of Screen | 78 | 78 | 78 | 78 | 78 | 78 | 47 | 95 | 94 |
| Web Height (centimeter) | 1.1 | 1.1 | 1.3 | 1.0 | 1.1 | 1.0 | 1.1 | 2.9 | 0.78 |
| Web Weight (g/m$^2$) | 68.2 | 80.6 | 82.2 | 69.7 | 73 | 27.1 | 46.5 | 225 | 104.6 |
| Web Density (g/cm$^3$ $\times 10^{-3}$) | 9.8 | 8.0 | 9.4 | 7.6 | 7.2 | 5.0 | 4.3 | 12.6 | 12.0 |
| Tensile Strength (m) | 498 | 466 | 413 | 539 | 490 | 527 | 384 | 103 | 342 |
| [3]Pressure Drop Through Web (mm $H_2O$) | 2.5 | 4.0 | 1.5 | 2.0 | 1.3 | .75 | 3.5 | 3.5 | 2.8 |
| [4]Oil Sorbency Ratio | | | | | | | | | |

[1]Slot Thickness of air orifice 0.3 mm
[2]Using about 200 0.3-millimeter-wide orifices
[3]Pressure drops measured at a face velocity of 10.6 meters/minute
[4]Grams of oil sorbed per gram basis-weight of web

| Example No. | 10 | 11 | 12 | 13 | 14 | 15 | 16 | 17 | 18 | 19 |
|---|---|---|---|---|---|---|---|---|---|---|
| Material of Microfibers | Polypropylene (melt flow of 12 grams/10 minutes) | | | | | | | | ** | Nylon 6 |
| Extruder Temperature (° C) | 316 | 302 | 260 | 316 | 316 | 316 | 260 | 315 | 327 | 355 |
| Die Temperature (° C) | 321 | 302 | 304 | 332 | 332 | 332 | 350 | 288 | 300 | 316 |
| Air Temperature (° C) | 454 | 482 | 482 | 454 | 454 | 454 | 445 | 445 | 205 | 205 |
| Air Flow to Die (standard liters per second) | 7 | 6.8 | | 5 | 5 | 5 | 6.2 | | | |
| Air Pressure (kg/cm$^2$) | 0.56 | 0.63 | 0.91 | 0.42 | 0.42 | 0.42 | 0.56 | 0.7 | 0.7 | 0.7 |
| Polymer Rate (g/min) | 19 | 20 | 27 | 18.3 | 18.4 | 18.4 | 26 | 24 | 28 | 39 |
| Collection Distance (centimeter) | 11.5 | 7.5 | 12 | 7 | 8.9 | 9.5 | 5.2 | 10 | 7.5 | 7.5 |
| Screen Viscosity (cm/sec) | 4.4 | 1.7 | 3.4 | 6.4 | 4.4 | 6.4 | 5 | 10 | 7.5 | 7.5 |
| Screen Type (figures of drawing) | 3 | 4 | 3 | 5 | 4 | 4 | 4 | 3 | 3 | 3 |
| Width of Openings in Screen ("c" in FIG.2 (centimeter) | 1.6 | 1.25 | 1.6 | 1.25 | 1.25 | 1.25 | 1.25 | 1.1 | 1.1 | 1.1 |
| Percent Open Area of Screen | 95 | 47 | 95 | 49 | 47 | 47 | 47 | 94 | 78 | 78 |
| Web Height (cm) | 1.7 | | | 0.6 | 1.4 | 1.1 | | | | |
| Weg Weight (g/m$^2$) | 108.5 | 176.7 | 108.5 | 74.4 | 97.7 | 65.1 | 157 | | 94 | 130 |
| Web Density (g/cm$^3$ $\times 10^{-3}$) | 8.0 | 24.0 | 16.0 | 16.0 | 16.0 | 8.5 | | | 11.0 | 12.1 |
| Tensile Strength (m) | 109 | 698 | 247 | 865 | 384 | 357 | 560 | | 69 | 59 |
| Pressure Drop Through Web (mm $H_2O$) | .75 | 8.6 | 3.0 | 6.3 | 4.0 | 1.5 | | | | |
| Oil Sorbency Ratio | | | | | | | 58 | | | |

**Polyethylene terephthalate

The bulk densities of the webs were measured as follows. A sample of the web was weighed, then allowed to saturate in an oil of known density, and then removed from the oil bath and immediately weighed. The total volume of the web was calculated by adding (1) the result obtained by dividing the weight of the web by the density of the polymer from which the microfibers were prepared and (2) the result obtained by dividing the weight of the oil by the density of the oil. The density of the web was calculated by dividing the weight of the web by the total volume of the web.

Utility of webs of the invention as oil sorbents

One set of the webs prepared — Examples 1 to 5 and 16 — were tested for use as an oil sorbent. For a web of microfibers to be useful as an oil sorbent it is desired that the web sorb many times weight in oil. Also minimum web tensile strength is desired.

The webs of Examples 1 to 5 and 16 can be compared with a commercially available oil sorbent that comprises a flat web of blown polypropylene microfibers, as shown in Table II. The oil sorbency ratio reported in the table is measured by placing a test web in mineral oil, allowing the web to be saturated with the oil, removing the saturated web, and placing the web on a screen where it is allowed to drip for one minute. The sample is weighed before and after this test, and the oil sorbency ratio is the ratio of the weight of the oil sorbed to the weight of the web prior to the test.

The performance index reported in the table is determined by multiplying the tensile strength of the web by the sorbency ratio.

A commerical oil sorbent typically has a strip tensile strength of approximately 450 meters, a density of 0.05 gram per cubic centimeter, sorbs 20 times its own weight, and thus has a performance index of about $9 \times 10^3$.

As seen in Table II, microfiber webs of the present invention exhibit tensile strength properties similar to those of the commercial oil sorbent but have considerably lower overall densities resulting in better oil sorbency ratios and higher performance indexes.

TABLE II

| Example No. | 1 | 2 | 3 | 4 | 5 | 16 | Commercial Sorbent |
|---|---|---|---|---|---|---|---|
| Tensile Strength (meters) | 498 | 466 | 413 | 539 | 490 | 560 | 421 |
| Oil Sorbency Ratio | 46 | 69 | 59 | 41 | 55 | 58 | 20 |
| Performance Density | | | | | | | |

TABLE II-continued

| Example No. | 1 | 2 | 3 | 4 | 5 | 16 | Commercial Sorbent |
|---|---|---|---|---|---|---|---|
| Index ($\times 10^3$) | | | | | | | |

Comparison with procedures for collecting flat blown microfiber webs

Comparative examples were prepared using conditions used for Example 1–7, except that a fine-mesh collection screen similar to those used in the prior art to collect flat webs (having openings of less than 1/16 inch — 1.5 millimeters) was used at two different collection distances. The results are shown in Table III, which gives values for Examples 1–7 and for each of the comparative examples (labeled A and B). One collection distance (for comparative Example A) was the same distance used in collecting the webs of Examples 1–7 and resulted in preparation of uniform flat webs. The second distance (for Comparative Example B) was the maximum distance at which a uniform low-density web could be collected.

TABLE III

| Example No. | | Tensile Strength (m) | Density ($g/cm^3 \times 10^{-3}$) | Sorbency Performance Index ($\times 1^{-2}$) | Pressure Drop (mm $H_2O$) | Collection Distance (cm) |
|---|---|---|---|---|---|---|
| | 1 | 487 | 9.8 | 5.1 | 2.5 | 7 |
| Comparison | 1A | 1419 | 36.2 | 3.9 | 33. | 7 |
| Comparison | 1B | 488 | 26.9 | 1.8 | 3.3 | 55 |
| | 2 | 466 | 8.0 | 5.8 | 4.0 | 7 |
| Comparison | 2A | 1464 | 29.4 | 5.0 | 20.8 | 7 |
| Comparison | 2B | 417 | 24.0 | 1.7 | 2.5 | 53 |
| | 4 | 539 | 7.6 | 7.1 | 2.0 | 6.4 |
| Comparison | 4A | 1636 | 26.1 | 6.2 | 30.5 | 6.4 |
| Comparison | 4B | 486 | 17.6 | 2.8 | 3.6 | 47 |
| | 5 | 490 | 7.2 | 6.8 | 1.3 | 6.4 |
| Comparison | 5A | 1527 | 39.5 | 3.8 | 12.5 | 6.4 |
| Comparison | 5B | 423 | 26.5 | 1.6 | 1.8 | 53 |
| | 6 | 527 | 5.0 | 10.5 | .75 | 5.7 |
| Comparison | 6A | 1824 | 28.1 | 6.5 | 16.3 | 5.7 |
| Comparison | 6B | 516 | 11.2 | 4.6 | 3.0 | 47 |
| | 7 | 384 | 4.3 | 8.9 | 3.5 | 5.7 |
| Comparison | 7A | 1824 | 28.1 | 6.5 | 16.3 | 5.7 |
| Comparison | 7B | 516 | 11.2 | 4.6 | 3.0 | 47 |

Table III reports a performance index that is the multiplication product of tensile strength and the inverse of the density of the web.

Efficiency in filtering solid particulate

The webs of Example 9 were tested for their efficiency in removing silica dust particles passed through a test chamber. The dust concentration averaged 46 milligrams per cubic meter and the flow rate was 40 cubic meters per minute. Particle penetration was measured by removing particulate downstream from the web using absolute filter paper. The duration of the test was 90 minutes. The results are shown in Table IV.

TABLE IV

| Ex. No. | Initial Pressure Drop (millimeters of water) | Final Pressure Drop (millimeters of water) | Penetration (milligrams) |
|---|---|---|---|
| 9A | 4.8 | 5.5 | 0.83 |
| 9B | 6.3 | 9.3 | 3.6 |

EXAMPLES 20 and 21

Pillowed webs of the invention loaded with carbon black were made by the procedure described in a copending application of Braun, Ser. No. 435,198, filed Jan. 21, 1974. The carbon black was "Witco" Grade 293, and the sample used passed a 50-mesh screen (U.S. Standard) but was held on a 140-mesh screen. The webs prepared were tested for their ability to absorb organic vapor (toluene with an input concentration of 1200 parts per million in air and at a flow rate of 13 liters per minute). The breakthrough time was the time until 50 parts per million of toluene vapor were measured downstream from the filter. Results are shown in Table V.

TABLE V

| Ex. No. | Carbon Loading (grams/square meter) | Pressure Drop (millimeters of water) | Breakthrough Time (minutes) |
|---|---|---|---|
| 20 | 232 | 8 | 5 |
| 21 | 837 | 9.5 | 16 |

What is claimed is:

1. A low-density web comprising a coherent mass of blown microfibers arranged into compacted high-density regions and pillowed low-density regions, the pillowed regions spanning the space between adjacent compacted regions, with the microfibers arching outwardly from their level in a compacted region into a pillowed region, whereby in a free-standing condition of the mass the pillowed regions are displaced to one side of a plane defined by the base of the compacted regions are anchored at their edges by the compacted regions and have an expanded and arched configuration in which the span length from compacted region to compacted region of the most highly arched microfibers is greater than that of less highly arched microfibers.

2. A web of claim 1 that is at least 5 millimeters thick.

3. A web of claim 1 in which the ratio of the densities of the high-density and low-density regions is at least 20 to 1.

4. A web of claim 1 in which the ratio of the densities of the high-density and low-density regions is at least 30 to 1.

5. A web of claim 1 in which the microfibers are melt-blown microfibers.

6. A web of claim 1 in which the microfibers are solution-blown microfibers.

7. A web of claim 1 in which the pillowed regions comprise spaced arched layers of microfibers that span the pillowed regions and are anchored at their edges to the compacted regions.

8. A web of claim 1 containing minute solid particles dispersed and physically entrapped within the interstices of the web.

9. A web of claim 1 prepared by collecting the microfibers on a collection screen so that the pillowed regions accumulate in the openings of the screen and the compacted regions form on the lands between the openings.

10. A low-density web comprising a coherent mass of blown microfibers arranged into a network of connected essentially linear compacted high-density regions and pillowed low-density regions, the pillowed regions spanning the space between adjacent compacted regions, with the microfibers arching outwardly from their level in a compacted region into a pillowed region, whereby in a free-standing condition of the mass the pillowed regions are displaced to one side of a plane defined by the base of the compacted regions and have an expanded and arched configuration in which the span length from compacted region to compacted region of the most highly arched microfibers is greater than that of less highly arched microfibers.

11. A web of claim 10 in which the pillowed regions comprise spaced arched layers of microfibers that span the pillowed regions and are anchored at their edges to the compacted regions.

12. A low-density web at least 5 millimeters thick comprising a coherent mass of blown microfibers arranged into a network of connected essentially linear compacted high-density regions and pillowed low-density regions, the pillowed regions spanning the space between adjacent compacted regions, with the microfibers arching outwardly from their level in a compacted region into a pillowed region, whereby in a freestanding condition of the mass the pillowed regions are displaced to one side of a plane defined by the base of the compacted regions are anchored at their edges by the compacted regions and have an expanded and arched configuration in which the span length from compacted region to compacted region of the most highly arched microfibers is greater than that of less highly arched microfibers, the ratio of the densities of the compacted and pillowed regions being at least 20 to 1.

13. A web of claim 12 in which the pillowed regions comprise spaced arched layers of microfibers that span the pillowed regions, and are anchored at their edges to the compacted regions.

14. A web of claim 12 in which the microfibers comprise polypropylene microfibers.

15. A web of claim 12 prepared by collecting the microfibers on a collection screen so that the pillowed regions accumulate in the openings of the screen and the compacted regions form on the lands between the openings.

* * * * *

UNITED STATES PATENT AND TRADEMARK OFFICE

CERTIFICATE OF CORRECTION

PATENT NO. : 4,103,058

DATED : July 25, 1978

INVENTOR(S) : Larry D. Humlicek

It is certified that error appears in the above-identified patent and that said Letters Patent are hereby corrected as shown below:

In column 5, line 26, "through" should be --though--.

In column 7, line 72, "Weg" should be --Web--.

In column 9, line 14, "times weight" should be --times its weight--.

In column 9, lines 69 and 70, "Performance Density" should be --Density Performance--.

In column 10, line 5, add the following numbers:

| Example No. | 1 | 2 | 3 | 4 | 5 | 16 | Commercial Sorbent |
|---|---|---|---|---|---|---|---|
| Density Performance Index (x $10^3$) | 22.9 | 32.9 | 24.4 | 22.1 | 26.9 | 32.5 | 8.4 |

In column 10, in Table III, under the column heading Sorbency Performance Index, "(x $1^{-2}$)" should be --x $10^{-2}$)--.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*